United States Patent [19]

Hess

[11] 4,411,193

[45] Oct. 25, 1983

[54] ROLLER GEAR DRIVE

[75] Inventor: Max W. Hess, North Richland Hills, Tex.

[73] Assignee: Dahlgren Manufacturing Company, Dallas, Tex.

[21] Appl. No.: 266,895

[22] Filed: May 26, 1981

[51] Int. Cl.[3] ..... B41F 7/26; B41F 7/36; B41F 7/40

[52] U.S. Cl. ..... 101/148

[58] Field of Search ..... 101/148, 147, 349, 350, 101/351, 352, 363; 192/46; 118/258, 259, 262

[56] References Cited

U.S. PATENT DOCUMENTS

| | | | |
|---|---|---|---|
| 2,532,404 | 12/1950 | Jagger | 192/46 |
| 2,905,294 | 9/1959 | Kellogg | 192/46 |
| 3,343,484 | 9/1967 | Dahlgren | 101/148 |
| 3,937,141 | 2/1976 | Dahlgren | 101/148 |
| 3,986,452 | 10/1976 | Dahlgren | 101/148 |
| 4,237,785 | 12/1980 | Dahlgren | 101/148 |

*Primary Examiner*—J. Reed Fisher

*Attorney, Agent, or Firm*—Gerald G. Crutsinger; John F. Booth; Monty L. Ross

[57] ABSTRACT

A drive system for rollers in pressure indented relation including a lug on a drive gear, which is rotatably mounted about one of the roller journals, and a projection on the roller journal such that the gear will drive the roller only when the lug and the projection are in engagement. The system provides a drive for driving rollers at different surface speeds, the drive being adapted to permit rotation of the rollers at equal surface speeds until lubricant is transferred to the nip between the rollers and thereafter at different surface speeds.

3 Claims, 5 Drawing Figures

ROLLER GEAR DRIVE

BACKGROUND OF INVENTION

A number of devices, for example as disclosed in U.S. Pat. No. 3,343,484, entitled LITHOGRAPHIC DAMPENER WITH SKEWED METERING ROLLER; U.S. Pat. No. 3,647,525, entitled METHOD AND MEANS FOR APPLYING LIQUID TO A MOVING WEB; U.S. Pat. No. 3,937,141, entitled DAMPENER FOR LITHOGRAPHIC PRINTING PLATES; U.S. Pat. No. 3,986,452, entitled LIQUID APPLICATOR FOR LITHOGRAPHIC SYSTEMS; and U.S. Pat. No. 4,041,864, entitled METHOD AND APPARATUS FOR INKING PRINTING PLATES, employ rollers urged into pressure indented relation and driven at different surface speeds to form a film of liquid of controlled thickness on the surface of one of the rollers.

Heretofore, it has been standard procedure for pressmen operating dampeners of the type disclosed in U.S. Pat. No. 3,343,484, to establish pressure between a metering roller and a transfer roller to form a film of the required thickness for application over one or more form rollers to the surface of a lithographic printing plate. The metering roller and transfer roller in such systems are often mounted in a common frame as disclosed in U.S. Pat. No. 3,168,037 to assure that the pressure between adjacent surfaces of the metering roller and the transfer roller will not be disturbed when the transfer roller is moved into and out of engagement with the surface of a form roller.

Generally, at least one of the metering and transfer rollers has been supplied with a resilient surface which is intended by the surface of the other roller and surfaces of the metering and transfer rollers are often driven at different surface speeds to accomplish metering of films of the desired thickness. When operating, dampening fluid is spread over the surfaces of the metering and transfer rollers and the liquid functions as a lubricant to maintain hydraulic separation between the surfaces which are moving at different surface speeds. However, when such systems are being made ready for operation, surfaces of the metering roller and transfer roller are generally dry and the lubricating layer of dampening fluid is not present. The dry surfaces of the rollers tend to stick together due to increased friction coefficient, resulting in damage to the surface of the resilient covered roller. Slippage between the driven dry surfaces also, scuffs or otherwise damages the resilient roller surface. In addition, in some instances, damage to the mechanical and elctrical drive systems has resulted when attempting to slip dry, heavily indented, surfaces of the rollers against each other.

SUMMARY OF INVENTION

The invention disclosed herein relates to an improved drive system for rollers urged into pressure indented relation to form a nip and driven at different surface speeds to form a film of liquid on one of the roller surfaces. The drive system comprises a pair of gears having different pitch diameters drivingly secured to the rollers.

One of the gears is rigidly secured to one of the rollers while the other gear is rotatably secured to the other roller to permit limited rotation of the gear relative to the roller. Thus, as the gears rotate, one of the rollers will be driven and will impart rotation to the second roller which moves relative to the gear for a limited distance. This initial rotation of the rollers will transfer liquid to the nip between the rollers to provide lubrication at the nip.

After the second roller has rotated a sufficient distance to lubricate the nip between the rollers, the tractive force at the nip will be reduced and the second roller will slow down or stop as slippage occurs at the nip between the roller surfaces. The gear on the second roller then begins to positively drive the second roller at a surface speed which is less than the surface speed of the first roller to maintain a supply of lubricating liquid at the nip.

Two embodiments of the drive system are disclosed. In the first embodiment, a lug is provided on the drive gear, which is rotatably mounted about the roller journal, and a projection is provided on the roller journal such that the gear will drive the roller only when the lug and the projection are in engagement. In the second embodiment, a sleeve is rigidly secured to the roller journal and the drive gear is rotatably secured to the sleeve. A lug is provided on the drive gear to drivingly engage a projection on the sleeve such that the gear will drive the sleeve and the roller only when the lug and the projection are engaged.

A primary object of the invention is to provide a drive for driving rollers at different surface speeds, the drive being adapted to permit rotation of the rollers at equal surface speeds until lubricant is transferred to the nip between the rollers.

Another object is to provide a drive gear for a roller which will drive the roller at a predetermined surface speed but which will permit momentary rotation of the roller at a faster surface speed.

A further object is to provide a drive gear rotatably secured to a sleeve with a lost motion connection between the gear and the sleeve to permit momentary rotation of the sleeve at an angular velocity which is greater than the angular velocity of the gear.

Other and further objects and advantages will become apparent upon referring to the detailed description hereinafter following and to the accompanying drawings.

DESCRIPTION OF THE DRAWINGS

Drawings of two embodiments of the invention are annexed hereto so that the invention may be better and more fully understood, in which.

Numeral references are employed to designate like parts throughout the various figures of the drawings.

DESCRIPTION OF A PREFERRED EMBODIMENT

Figure 1:
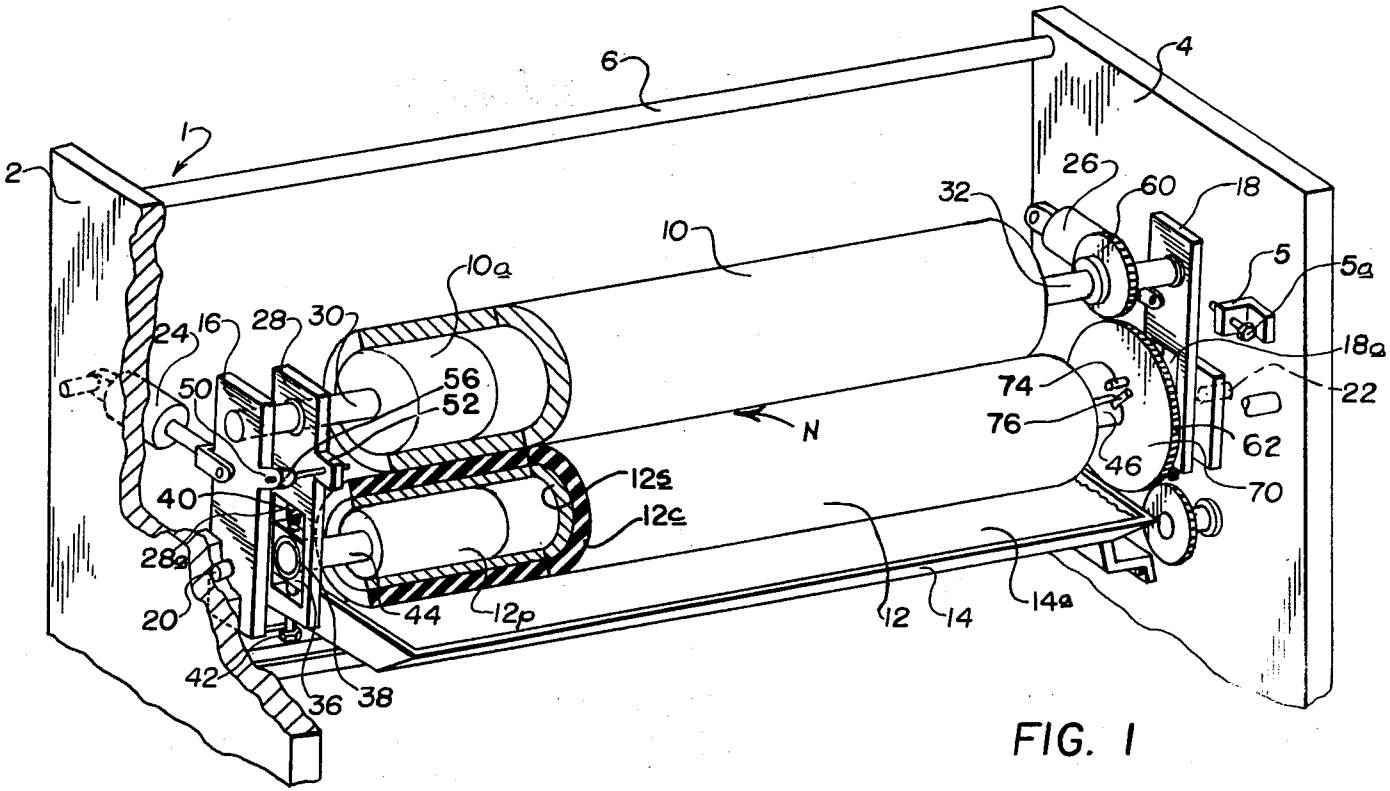
FIG. 1 is a diagrammatic perspective view of a dampener for a lithographic printing press having the roller gear drive mounted thereon.

In FIG. 1 of the drawing the numeral 1 generally designates a liquid applicator system adapted for use in conjunction with inker apparatus for applying dampening fluid and ink to a lithographic printing plate of a printing press.

Liquid applicator 1 comprises spaced side frames 2 and 4 joined by tie bar 6 forming a strong rigid structure for supporting transfer roller 10, metering roller 12 and dampening fluid pan 14.

As will be hereinafter more fully explained, two embodiments of an improved gear drive for rollers 10 and 12 are illustrated in the drawings. In the embodiment illustrated in FIG. 3, gear 70 initially rotates freely on journal 46 of metering roller 12 to drive gear 60 and transfer roller 10. Metering roller 12 is initially driven by friction between rollers 10 and 12 at nip N. However, when liquid is carried on the surface of metering roller 12 to lubricate nip N, and when pin 74 moves into engagement with projection 76, metering roller 12 will thereafter be positively driven by gear 70.

Throw-off links 16 and 18 are pivotally secured by stub shafts 20 and 22 to the respective side frames 2 and 4. Throw-off cylinders 24 and 26 are pivotally connected between side frames 2 and 4 and throw-off links 16 and 18, and pivot link 16 and 18 about stub shafts 20 and 22 for moving transfer cylinder 10 into position, as will be hereinafter more fully explained, for delivering dampening fluid to a lithographic printing system.

A skew arm 28 is mounted for pivotal movement about the axis of transfer roller 10. As diagrammatically illustrated in FIG. 1, skew arm 28 is rotatably secured about journal 30 extending outwardly from the end of transfer roller 10.

Skew arm 28 and throw-off link 18 have passages **28*a* and 18*a* respectively, formed in lower ends thereof in which blocks 36 carrying self-aligning bearing 38 are slidably disposed. Suitable means such as resilient springs 40 urge blocks 36 longitudinally of skew arm 28 and throw-off link 18 in a direction away from the longitudinal axis of transfer roller 10. A pressure adjustment screw 42 urges blocks 36 longitudinally of skew arm 28 and throw-off link 18 against the bias of springs 40. Journals 44 and 46, extending outwardly from opposite ends of metering roler 12, are received in self-aligning bearings 38 to rotatably secure metering roller 12 in pressure indented relation with transfer roller 10**.

It should be readily apparent that rotation of pressure adjustment screws 42 will move opposite ends of metering roller 12 relative to the axis of transfer roller 10 for controlling pressure between transfer roller 10 and metering roller 12.

Suitable means is provided for establishing and maintaining a desired angular relationship between throw-off link 16 and skew arm 28. In the form of the invention illustrated in the drawing a lock bolt 50 extends through an aperture in lug 52 on skew arm 28 and is received in an arcuate slot 54, having a center of curvature coincident with the axis of transfer roller 10, formed in a lug 56 on throw-off link 16.

It should be readily apparent that bolt 50 can be loosened permitting rotation of skew arm 28 about the axis of transfer roller 10 and tightened to maintain a desired angular relationship between throw-off link 16 and skew arm 28.

Side frames 2 and 4 have suitable adjustable stop means such as angle members 5 having screw **5*a* extending therethrough for engaging throw-off links 16 and 18 when rods of throw-off cylinders 24 and 26 are extended for establishing a desired pressure relationship between the transfer roller 10** and an ink coated form roller arranged to transfer dampening fluid to a lithographic printing plate as will be hereinafter more fully explained.

Journal 32 extending outwardly from the end of transfer roller 10 has a gear 60 secured thereto in meshing relation with a gear 70 rotatably disposed on journal 46 extending outwardly from the end of metering roller 12.

Suitable means 14 is provided for providing an abundant supply of dampening fluid to the nip N between adjacent surfaces of transfer roller 10 and metering roller 12.

In the particular embodiment of the invention illustrated in FIG. 1 a portion of the surface of metering roller 12 is submerged in dampening fluid **14*a* in dampening fluid pan 14**.

The dampening fluid may be moistening fluid such as water with other ingredients added thereto, such as gum, etch and material to lower the surface tension of the water for reducing the tendency of the water to form globules on the surface of ink which would prevent uniform distribution of a film of dampening fluid over a film of ink.

Dampening fluid **14*a*** preferably comprises a mixture of water and water soluble, volatile, organic liquid such as alcohol, esters, ketones, and similar compounds which are compatible with, and receptive to, oil-based ink. Commercial grade isopropyl alcohol is preferably employed because of its economy and ready availability. Such material is molecularly compatible with ink because the vehicle of the ink is organic material and the dampening fluid containing alcohol is organic material.

It has been found that mixing 10 to 25% alcohol with water works satisfactorily for most lithographic printing operations. Dampening fluid containing alcohol is quickly absorbed in the inking system because it is ink compatible and rides on and into the surface of ink coated form rollers in a uniformly thin layer and evaporates quickly. Upon evaporation alcohol does not cause oxidization as does water and provides a cooling agent for the rollers running in contact. Other important reasons for the use of alcohol are numerous but are not deemed necessary to be discussed herein.

The transfer roller 10 is preferably plated, ground, metal and has an exterior surface which is machined, polished and chemically treated to render it moisture receptive and permanently hydrophillic.

It has been found that the surface of the roller 10 so treated will pick up a uniform film of moisture from the nip N between transfer roller 10 and metering roller 12 and such film of dampening fluid on roller 10 is rotated to contact the surface of the ink coating on the surface of form roller 90.

Transfer cylinder 10 preferably comprises a hollow tubular sleeve having plugs **10*a* in the ends thereof on which journals 30 and 32 are formed. As hereinbefore explained, journal 30 extends through a bushing in skew arm 28 and a bearing throw-off link 16 and journal 32 is rotatably mounted in a bearing in the upper end of throw-off link 18**.

Metering roller 12 preferably comprises a hollow tubular sleeve 12*s* having plugs 12*p* extending into opposite ends thereof. Plugs 12*p* have journals 44 and 46 formed thereon.

A resilient cover 12*c* is secured about the outer surface of sleeve 12*s*. A process for forming resilient cover 12*c* is described in U.S. Pat. No. 3,514,312 to provide a roller comprising the metal substrate 12*s* having an adhesive bonded to it, a layer of relatively hard plastic bonded to the adhesive, and a layer of softer plastic fused to and co-mingled with the intermediate layer of harder plastic.

Figure 2:
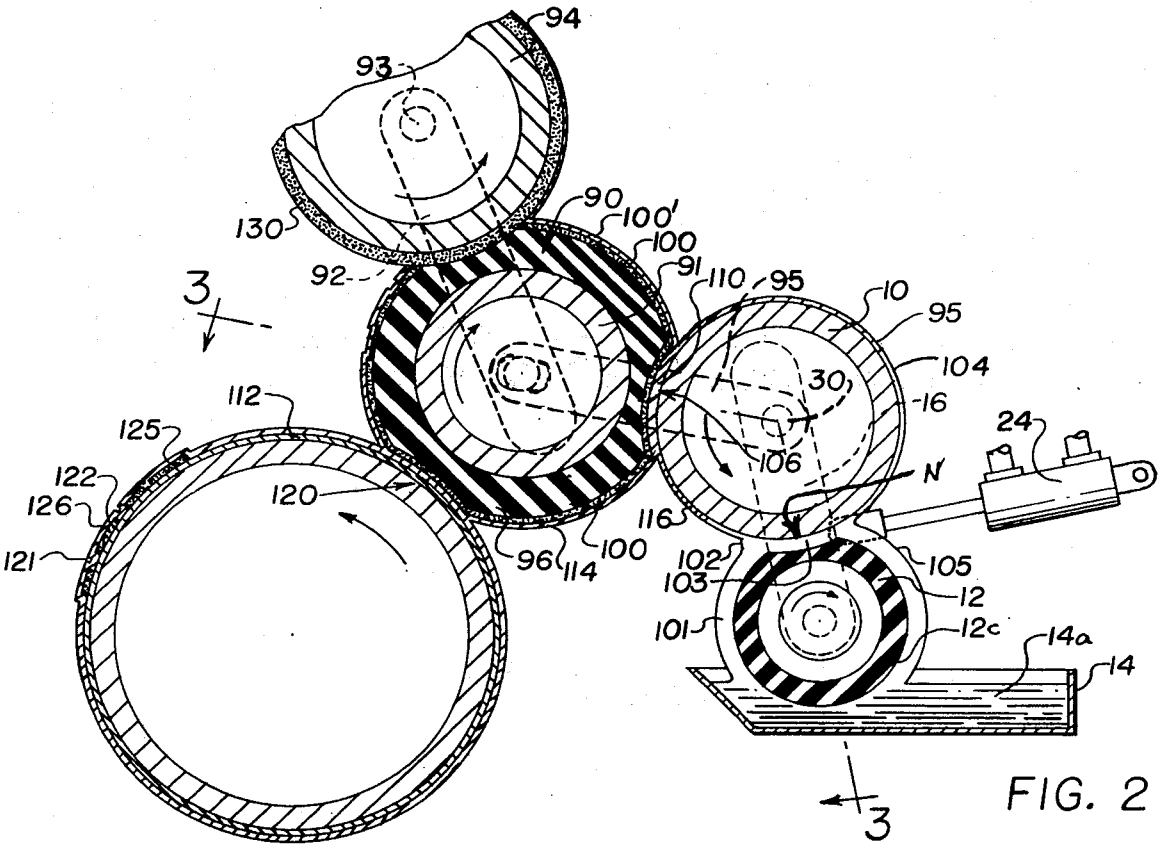
FIG. 2 is an enlarged diagrammatic view illustrating the relative positions of the source of dampening fluid, a metering roller, a transfer roller and a form roller in a lithographic printing system.

Referring to FIG. 2 of the drawing, transfer roller 10 is preferably positioned in pressure indented relation with a form roller 90 having a metal tubular core 91, to the ends of which are secured journals extending outwardly therefrom and rotatably mounted in bearings carried by links 92 pivotable about a shaft 93 rotatably secured to the side frames of a printing press and carrying an inker vibrator roller 94. Roller 90 has a smooth resilient non-absorbent outer cover 96.

A connector 95 is pivotally secured to the ink 92 and throw-off link 16 and is positioned such that the surface of roller 90 is separated from the surface of the printing plate 112 and from the surface of transfer roller 10 when the dampener is thrown off.

Roller 94 is preferably a vibrator roller of conventional design and is adapted to apply a film of ink 100 to surfaces of form roller 90.

Figure 3:
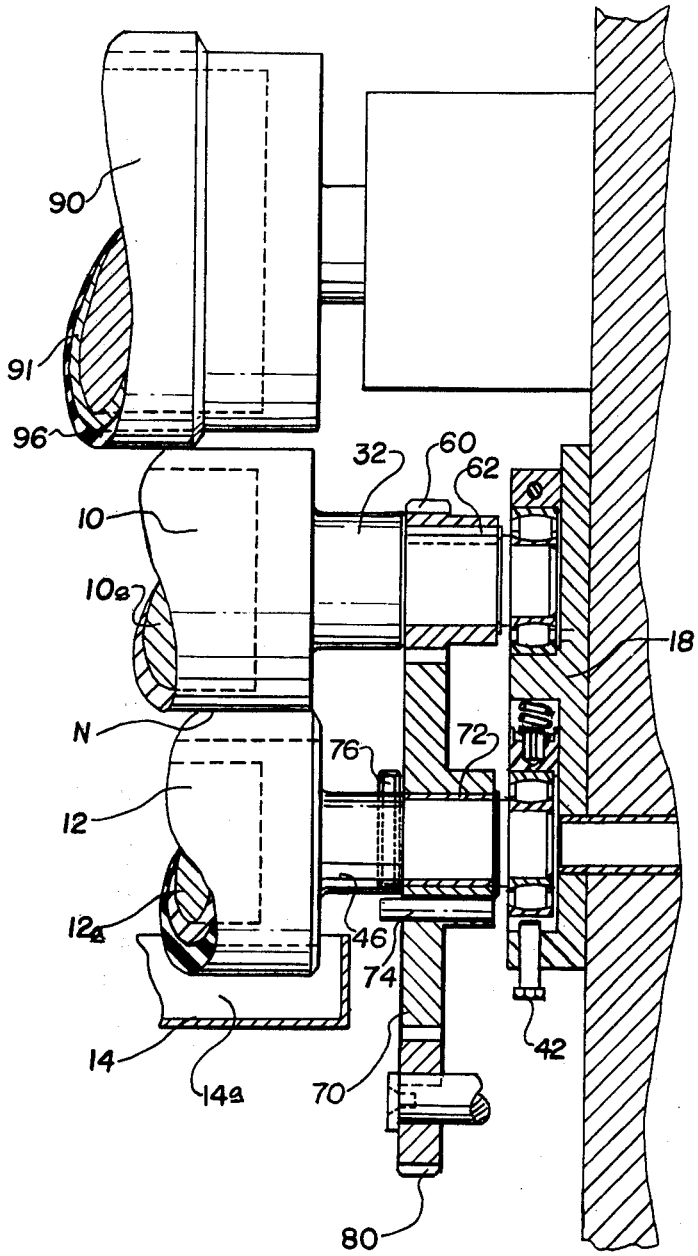
FIG. 3 is an enlarged cross-sectional view taken along line 3—3 of FIG. 2.

As best illustrated in FIG. 3, gear 60 is secured to journal 32 by a key 62 to drivingly connect gear 60 to transfer roller 10.

Gear 70 is rotatably mounted on a bushing 72 through which journal 46 extends. A pin 74 extends into an aperture formed in gear 70 to form a lug which has an axis spaced from and parallel to the axis of metering roller 12. A pin 76 extends into an opening formed in journal 46 to form a projection having an axis which is perpendicular to the axis of metering roller 12. The ends of lug 74 and projection 76 are movable into engagement so that gear 70 drives metering roller 12 at a predetermined surface speed which is slower than the surface speed at which transfer roller 10 is driven by gear 60. However, if lubricant is not present at nip N between rollers 10 and 12, the faster driven transfer roller 10 will transmit frictional force through nip N to metering roller 12. When metering roller 12 is driven by frictional force through nip N, projection 76 will move away from lug 74 until liquid carried by the surface of metering roller 12 provides lubrication at nip N.

Gear 70 is driven by a gear 80 in a gear train which is driven by an electric motor (not illustrated).

Figure 4:
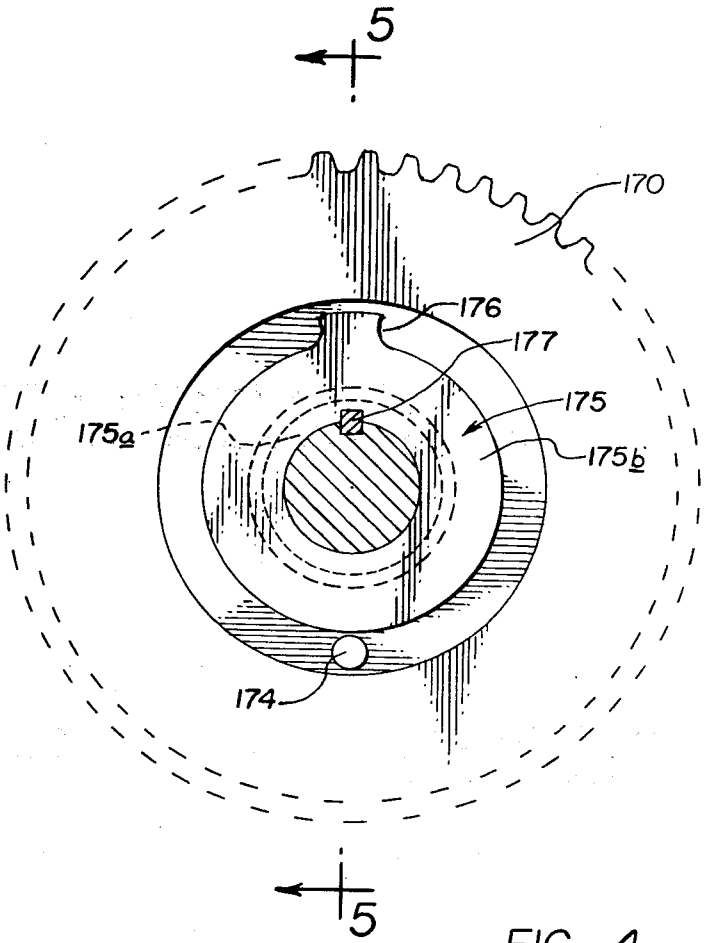
FIG. 4 is a side elevational view of a modified form of the gear drive.
Figure 5:
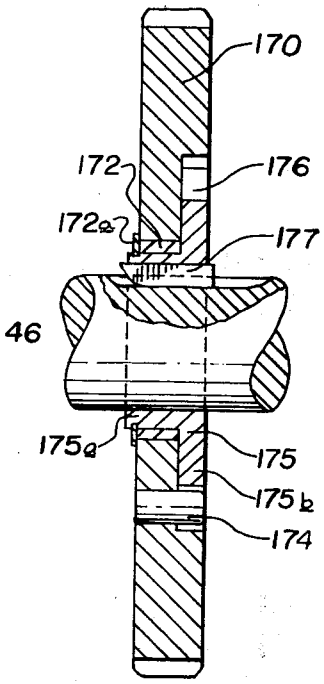
FIG. 5 is a cross-sectional view taken along line 5—5 of FIG. 4.

A second embodiment of the drive system is illustrated in FIGS. 4 and 5 of the drawing. Gear 170 has a central opening in which a sleeve 175, having a projection 176, is rotatably disposed. Pin 174 extending into an aperture in gear 170 forms a lug which is engageable with projection 176. The sleeve 175 is connectible to journal 46 on metering roller 12 by a key 177 to cause the key to rotate with the roller journal 46.

The sleeve 175 preferably comprises a cylindrical body portion 175*a*, having a keyway formed therein to receive key 177, and having an enlarged cylindrical flange 175*b* from which projection 176 extends. A bushing 172, positioned between the outer surface of body 175*a* and the inner surface of the central opening in gear 170, is held in position by a snap ring 172*a* secured to sleeve 175.

The operation and function of the apparatus hereinbefore described is as follows:

Pressure between ends of transfer roller 10 and metering roller 12 is adjusted by rotating pressure adjustment screws 42.

Since long rollers urged together in pressure relation tend to deflect or bend, pressure adjacent centers of such rollers is less than pressure adjacent ends thereof. Pressure longitudinally of rollers 10 and 12 is adjusted by loosening bolt 50 and rotating skew arm 28 about the axis of transfer roller 10 to a position wherein a desired pressure distribution longitudinally of rollers 10 and 12 is obtained.

Adjustment screw 5 is positioned to engage throw-off links 16 and 18 for establishing a desired pressure between transfer roller 10 and form roller 90.

The differential in the surface speeds of transfer roller 10 and metering roller 12 is established by selecting gears 60 and 70 to establish a desired speed ratio. The transfer roller 10 may be driven, for example, at twice the speed of metering roller 12.

For the purpose of graphically illustrating the novel function and results of the process of the mechanism hereinbefore illustrated and described, an enlarged, exaggerated, diagrammatic view of the metering roller 12, the transfer roller 10 and the form roller 90 is shown in FIG. 2.

As shown in the exaggerated illustration, metering roller 12, which is preferably a resilient surfaced roller having a smooth surface 12*c* thereon, has the lower side thereof immmersed in dampening fluid 14*a* in pan 14. The roller 12 is in rotative contact with the hard surfaced transfer roller 10, and the pressure therebetween is adjusted as hereinbefore described, so that the surface of transfer roller 10 is actually impressed into the surface of roller 12 as indicated at nip N.

As roller 12 rotates toward the nip N between rollers 10 and 12, a relatively heavy layer 101 of dampening fluid is picked up and lifted on the surface of roller 12 to the nip N, between the rollers 10 and 12. A bead 102 of dampening fluid is piled up, the greatness of which is regulated by virtue of the fact that excess dampening fluid will fall back into the pan 14 by gravity, thus virtually creating a waterfall. The bead 102 becomes a reservoir from which dampening fluid is drawn by transfer roller 10. As rollers 10 and 12 rotate in pressure indented relation, a relatively thin layer of dampening fluid is metered between adjacent surfaces of the two rollers, as indicated at 103. Since the transfer roller 10 is treated to provide a smooth, hydrophillic surface thereon, a portion of the film 103 adheres to the surface of roller 10 as indicated at 104, the remaining portion 105 thereof being rotated back on metering roller 10 to fluid 14*a* in the pan 14. The film of dampening fluid 104 is evenly distributed on the surface of roller 10 by reason of the rotating, shearing and squeezing action between rollers 10 and 12 at their tangent point at nip N.

The film of dampening fluid 104 rides on the surface of roller 10 and comes in contact with the film 100 of viscous ink on form roller 90 at the nip 106 between said rollers.

At tangent point 106 it will be observed that transfer roller 10 is impressed into the resilient surface of form roller 90 and that the film of dampening fluid 104 has an outer face 108, contacting ink film 100, and an inner face 110 adhering to the surface of roller 10 and actually separates the surfaces of transfer roller 10 and form roller 90, so that there is in fact a hydraulic connection between rollers 10 and 90 as they rotate in close slipping relationship, but there is no physical contact therebetween.

It is an important fact to note that the film of dampening fluid 104 permits rollers 10 and 90 to be rotated at different surface speeds as will be hereinafter explained. Preferably, the form roller 90, which is normally rotated at the same surface speed as the lithographic printing plate 112, is rotated at a greater surface speed than the surface speed of roller 10, however, it will be understood that transfer roller 10 could be rotated at a greater surface speed than applicator roller 90 and accomplish the same functions and result as hereinafter related. By regulating the differential surface speed between transfer roller 10 and applicator roller 90 the amount of dampening fluid applied to the plate 112 may be regulated.

Within limits, as will be hereinafter more fully explained, if the surface speed of transfer roller 10 is increased, the dampening fluid film 104 is presented at the tangent point 106 at a faster rate and more dampening fluid is transferred on the surface of ink film 100 to lithographic printing plate 112, and the opposite is true, if the surface speed of roller 10 is decreased. To prevent deterioration of the surfaces of form roller 90 and transfer roller 10, form roller 90 is coated with ink and transfer roller 10 is coated with dampening fluid before rollers 10 and 90 are moved into a pressure indented relationship.

As has been hereinbefore explained, under certain operating conditions it is not desirable to disturb the pressure adjustment at nip N between the transfer roller 10 and metering roller 12 before roller 10 and 12 become coated with dampening fluid.

In FIG. 3, the gear 60 is rigidly secured to transfer roller 10 while the gear 70 is rotatably secured to metering roller 12 to permit limited rotation of gear 70 relative to metering roller 12. Thus, as gears 60 and 70 rotate, transfer roller 10 will be driven by gears 60, 70 and 80 and will impart rotation to the metering roller 12 which moves relative to gear 70 for a limited distance. This initial rotation of rollers 10 and 12 will transfer liquid to the nip N between the rollers to provide lubrication at the nip N.

After the metering roller has rotated a sufficient distance to lubricate the nip N between the rollers, the tractive force at the nip N will be reduced and the metering roller 12 will slow down or stop as slippage occurs at the nip N between the roller surfaces. The gear 70 on the metering roller 12 then begins to positively drive the metering roller at a surface speed which is less than the surface speed of the transfer roller 10 to maintain a supply of lubricating liquid at the nip 10.

It should be readily apparent that the drive system is reversible and will permit reversing the direction of rotation of the rollers 10 and 23 if it is deemed expedient to do so.

In the first embodiment illustrated in FIG. 3, a lug 74 is provided on the drive gear 70, which is rotatably mounted on the roller journal 46, and a projection 76 is provided on the roller journal 46, such that the gear 70 will drive the roller 12 only when the lug 74 and the projection 76 are in engagement. In the second embodiment illustrated in FIGS. 4 and 5, a sleeve 175 is rigidly secured to the roller journal 46 and the drive gear 170 is rotatably secured to the sleeve 175. A lug 174 is provided on the drive gear 170 to drivingly engage a projection 176 on the sleeve 175 such that the gear 170 will drive the sleeve 175 and the roller 10 only when the lug 174 and the projection 176 are engaged.

Thus, the gears 60 and 70 drive rollers 10 and 12 at different surface speeds, the drive being adapted to permit rotation of the rollers 10 and 12 at equal surface speeds until lubricant is transferred to the nip N between the rollers.

The arrangement of lug 174 and projection 176 provides a drive gear rotatably secured to a sleeve 175 with a lost motion connection between the gear 170 and the sleeve 175 to permit momentary rotation of the sleeve 175 at an angular velocity which is greater than the angular velocity of the gear 170.

Provided the differential speed between surfaces of transfer roller 10 and form roller 90 does not exceed permissible limits under given operating conditions, the film 104 of dampening fluid will split as rollers 10 and 90 rotate away from a tangent point therebetween in nip 106. A film of dampening fluid 114 adheres to the surface of the film 100 of more viscous ink carried by form roller 90 and a film 116 of dampening fluid adheres to the surface of the transfer roller 10 from whence it is conveyed back to the bead 102 of dampening fluid adjacent nip N.

It has already been explained that the dampening fluid film 104 is smoothed out, distributed, metered, and regulated between the tangent points of rollers 10 and 90. The interfaced tension between the outer surface 108 of the less viscous dampening fluid film 104, by reason of molecular attraction between the face of the more viscous ink film 100, causes the smoothened and regulated film 104 to be transferred onto and into the surface of ink 100, which in turn is transferred to the plate at the tangent point between the plate 112 and form roller 90, as indicated at 120.

From the foregoing, it should be apparent that by frictionally driving roller 12 until nip N becomes lubricated allows the system to be started without undue concern that rollers 10 and 12 may be damaged.

The lithographic printing plate 112 has hydrophillic, or water liking, non-image areas 121 and oleophillic, or ink receptive, image areas 122 formed on the surface thereof.

At the nip 120 between applicator roller 90 and printing plate 112, the ink film 100 is split, forming films 125 of ink over oleophillic surfaces 122 on the printing plate. The layer 114 of dampening fluid carried on film 100 of ink is distributed to form a thin film 126 of dampening fluid over hydrophillic areas 121 of the printing plate and with ink 125 thereon.

Having described my invention, I claim:

1. In a liquid metering device wherein first and second rollers are urged into pressure indented relation to form a metering nip, liquid being transferred to the metering nip by the second of the pair of rollers, the improvement comprising: a drive gear rotatable relative to said second roller; a first drive pin on the drive gear; a second pin connected to said second roller, said first pin being disposed to engage the second pin to limit rotation of the drive gear relative to the second roller; and a driven gear secured to said first roller, said driven gear being disposed in meshing relation with said drive gear such that initial rotation of said drive gear imparts rotation through said driven gear for rotating said first roller and said second roller such that adjacent surfaces of the first and second roller move in the same direction at substantially equal surface speeds until said first pin engages said second pin to cause adjacent surfaces of the first and second rollers to move in the same direction at different surface speeds.

2. In a liquid metering device wherein first and second rollers are urged into pressure indented relation to form a metering nip, liquid being transferred to the metering nip by the second roller, the improvement comprising: a driven member on a journal of the first of said rollers; a hub connected to a journal on the second of said rollers; a radially extending projection on said hub; a drive member rotatably supported on said hub; a shoulder on said drive member positioned to engage the projection on said hub to permit rotation of the rollers by frictional force between adjacent surfaces of the rollers until said projection engages said shoulder to provide a positive driving force for moving adjacent surfaces of said first and second rollers in the same direction at different surface speeds.

3. In a liquid metering device wherein first and second rollers are urged into pressure indented relation to form a metering nip, liquid being transferred to the metering nip by the second of the pair of rollers, the improvement comprising: a drive member rotatable relative to said second roller; a first pin on the drive member; a second pin connected to said second roller, said first pin being disposed to engage the second pin to limit rotation of the drive member relative to the second roller; a driven member secured to said first roller; and drive means associated with said drive member and said driven member such that initial rotation of said drive means imparts rotation to one of the rollers for rotating said first roller and said second roller such that adjacent surfaces of the first and second roller move in the same direction at substantially equal surface speeds until said first pin engages said second pin to cause adjacent surfaces of the first and second rollers to move in the same direction at different surface speeds.

* * * * *